US006059997A

United States Patent [19]

Hall

[11] Patent Number: 6,059,997

[45] **Date of Patent: *May 9, 2000**

[54] POLYMERIC PTC COMPOSITIONS

[75] Inventor: Tom J. Hall, Arlington Heights, Ill.

[73] Assignee: Littlelfuse, Inc., Des Plaines, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/614,038

[22] Filed: Mar. 12, 1996

Related U.S. Application Data

[60] Provisional application No. 60/004,600, Sep. 29, 1995.

[51] Int. Cl.[7] ..... H01B 1/20; H01B 1/24

[52] U.S. Cl. ..... 252/500; 252/511

[58] Field of Search ..... 252/510, 511, 252/500

[56] References Cited

U.S. PATENT DOCUMENTS

| | | | |
|---|---|---|---|
| 2,978,665 | 4/1961 | Vernet et al. | 338/223 |
| 3,241,026 | 3/1966 | Andrich | 318/442 |
| 3,243,753 | 3/1966 | Kohler | 338/31 |

(List continued on next page.)

FOREIGN PATENT DOCUMENTS

| | | | |
|---|---|---|---|
| 1 253 332 | 4/1965 | Germany . | |
| 3707505 | 3/1986 | Germany | H01C 7/02 |
| 50-33707 | 12/1972 | Japan . | |
| 53-104339 | 1/1977 | Japan . | |
| 52-62680 | 5/1977 | Japan . | |
| 62-164763 | 7/1987 | Japan . | |
| 62-181347 | 8/1987 | Japan . | |
| 62-232902 | 10/1987 | Japan . | |
| 5-109502 | 10/1991 | Japan . | |
| 60-196901 | 8/1994 | Japan . | |
| 541222 | 11/1941 | United Kingdom . | |
| 604695 | 7/1948 | United Kingdom . | |
| 1172718 | 12/1969 | United Kingdom . | |
| 1449261 | 9/1976 | United Kingdom . | |
| 1604735 | 12/1981 | United Kingdom . | |

OTHER PUBLICATIONS

Sorimachi, Yoshio, Ichiro Tsubata and Noboru Nishizawa, The Transactions of the Institute of Electronics and Communication Engineers of Japan, Analysis of Static Self Heating Characteristics of PTC Thermistor Based on Carbon Black Graft Polymer, vol. J61–C, No. 12, pp. 767–774 (Dec. 25, 1978).

Tsubata, Ichiro and Yoshio Sorimachi, Faculty of Engineering, Niigata University, *PTC Characteristics and Components on Carbon Black Graft Polymer*, pp. 31–38 (with translation).

Sorimachi, Yoshio and Ichiro Tsubata, The Transactions of the Institute of Electronics and Communication Engineers of Japan, Characteristics of PTC–Thermistor Based on Carbon Black Graft Polymer, vol. J60–C, No. 2, pp. 90–97 (Feb. 25, 1977).

Sorimachi, Yoshio and Ichiro Tsubata, Niigata University, *The Analysis of Current Falling Characteristics on C.G. (Carbon Black Graft Polymer)–PTC Thermistor*, pp. 23–27.

Wartgotz, B. and W.M. Alvino, Polymer Engineering and Science, *Conductive Polyethylene Resins from Ethylene Copolymers and Conductive Carbon Black*, pp. 63–70 (Jan., 1967).

Ohe, Kazuyuki and Yoshihide Naito, Japanese Journal of Applied Physics, A New Resistor Having an Anomalously Large Positive Temperature Coefficient, vol. 10, No. 1, pp. 99–108 (Jan., 1971).

(List continued on next page.)

*Primary Examiner*—Mark Kopec
*Attorney, Agent, or Firm*—Wallenstein & Wagner, Ltd.

[57] ABSTRACT

Circuit protection devices comprising PTC elements and circuits containing such devices. The PTC element includes a crystalline conductive polymer composition comprising a conductive particulate filler grafted to a modified polyolefin. The modified polyolefin comprises a polyolefin having a carboxylic acid or a carboxylic acid derivative grafted thereto. The conductive particulate filler is grafted via an esterification reaction to the modified polyolefin.

17 Claims, 3 Drawing Sheets

U.S. PATENT DOCUMENTS

| | | | |
|---|---|---|---|
| 3,351,882 | 11/1967 | Kohler | 338/322 |
| 3,591,526 | 7/1971 | Kawashima et al. | 252/511 |
| 3,823,217 | 7/1974 | Kampe | 264/105 |
| 3,858,144 | 12/1974 | Bedard et al. | 338/22 R |
| 4,124,747 | 11/1978 | Murer et al. | 429/210 |
| 4,188,276 | 2/1980 | Lyons et al. | 204/159 |
| 4,237,441 | 12/1980 | van Konyenenburg et al. | 338/22 |
| 4,238,812 | 12/1980 | Middleman et al. | 361/106 |
| 4,304,987 | 12/1981 | van Konynenburg | 219/553 |
| 4,329,726 | 5/1982 | Middleman et al. | 361/58 |
| 4,388,607 | 6/1983 | Toy et al. | 338/22 |
| 4,413,301 | 11/1983 | Middleman et al. | 361/106 |
| 4,426,633 | 1/1984 | Taylor | 338/25 |
| 4,475,138 | 10/1984 | Middleman et al. | 361/58 |
| 4,534,889 | 8/1985 | van Konynenburg et al. | 252/511 |
| 4,560,498 | 12/1985 | Horsma et al. | 252/511 |
| 4,689,475 | 8/1987 | Kleiner et al. | 219/553 |
| 4,774,024 | 9/1988 | Deep et al. | 252/511 |
| 4,775,778 | 10/1988 | van Konynenburg et al. | 219/549 |
| 4,800,253 | 1/1989 | Kleiner et al. | 219/553 |
| 4,857,880 | 8/1989 | Au et al. | 338/22 R |
| 4,880,577 | 11/1989 | Okita et al. | 264/22 |
| 4,884,163 | 11/1989 | Deep et al. | 361/58 |
| 4,910,389 | 3/1990 | Sherman et al. | 219/548 |
| 4,980,541 | 12/1990 | Shafe et al. | 219/548 |
| 5,089,801 | 2/1992 | Chan et al. | 338/22 R |
| 5,106,538 | 4/1992 | Barma et al. | 252/511 |
| 5,106,540 | 4/1992 | Barma et al. | 252/511 |
| 5,171,774 | 12/1992 | Ueno et al. | 524/495 |
| 5,174,924 | 12/1992 | Yamada et al. | 252/511 |
| 5,190,697 | 3/1993 | Ohkita et al. | 252/511 |
| 5,195,013 | 3/1993 | Jacobs et al. | 361/106 |
| 5,196,145 | 3/1993 | Ishii et al. | 252/511 |
| 5,231,371 | 7/1993 | Kobayashi | 338/22 R |
| 5,247,276 | 9/1993 | Yamazaki | 338/22 R |
| 5,250,226 | 10/1993 | Oswal et al. | 252/500 |
| 5,280,263 | 1/1994 | Sugaya | 338/22 R |
| 5,303,115 | 4/1994 | Nayar et al. | 361/106 |
| 5,374,379 | 12/1994 | Tsubokawa et al. | 252/511 |
| 5,382,384 | 1/1995 | Baigrie et al. | 252/511 |
| 5,580,493 | 12/1996 | Chu et al. | 252/511 |
| 5,814,264 | 9/1998 | Cai et al. | 264/408 |
| 5,864,280 | 1/1999 | Hall | 338/22 R |
| 5,880,668 | 3/1999 | Hall | 338/22 R |

OTHER PUBLICATIONS

Tsubata, Ichiro and Naomitsu Takashina, 10th Regional Conference on Carbon, *Thermistor with Positive Temperature Coefficient Based on Graft Carbon*, pp. 235–236 (1971).

Meyer, J., Polymer Engineering and Science, *Glass Transition Temperature as a Guide to Selection of Polymers Suitable for PTC Materials*, vol. 13, No. 6, pp. 462–468 (Nov., 1973).

Meyer, J., Polymer Engineering and Science, *Stability of Polymer Composites as Positive–Temperature–Coefficient Resistors*, vol. 14, No. 10, pp. 706–716 (Oct., 1974).

Sorimachi, Yoshio and Ichiro Tsubata, Shengakeekai Parts Material, Characteristics of PTC–Thermistor Based on Carbon Black Graft Polymer, Paper No. UDC 621.316.825.2: [678.744.32–13:661.666.4.

Klason, Carl and Josef Kubat, Journal of Applied Polymer Science, Anomalous Behavior of Electrical Conductivity and Thermal Noise in Carbon Black–Containing Polymers at $T_g$ and $T_m$, vol. 19, pp. 831–845 (1975).

Sorimachi, Yoshio and Ichiro Tsubata, Shengaku.Gehou, Electronics Parts and Materials, The Analysis of Current Falling Characteristics of C.G. Carbon Black Graft Polymer)–PTC Thermistor, Paper, vol. 9, ED–75–35 75–62, (1975).

Narkis, M., A. Ram and F. Flashner, Polymer Engineering and Science, *Electrical Properties of Carbon Black Filled Polyethylene*, vol. 18, No. 8 pp. 649–653 (Jun., 1978).

Voet, Andries, Rubber Chemistry and Technology, Temperature Effect of Electrical Resistivity of Carbon Black Filled Polymers, vol. 54, pp. 42–50.

Narkis, M., A. Ram and Z. Stein, Journal of Applied Polymer Science, Effect of Crosslinking on Carbon Black/Polyethylene Switching Materials, vol. 25, pp. 1515–1518 (1980).

Doliack, Frank A., IEEE Transactions on Components Hybrids and Manufacturing, Technology, *PolySwitch Devices–A New Low–Resistance Conductive Polymer–Based PTC Device for Overcurrent Protection*, vol. CHMT, No. 4, pp. 372–378 (Dec., 1981).

Miyasaka, Keizo et al., Journal of Materials Science, Electrical Conductivity of Carbon–Polymer Composites as a Function of Carbon Content, vol. 17, pp. 1610–1616, (1982).

Bigg, D.M., Conductivity in Filled thermoplastics, An Investigation of the Effect of Carbon Black Structure, Polymer Morphology, and Processing History on the Electrical Conductivity of Carbon–Black–Filled Thermoplastics, pp. 501–516.

Yacubowicz, J. and M. Narkis, Polymer Engineering and Science, Dielectric Behavior of Carbon Black Filled Polymer Composites, vol. 26, No. 22, pp. 1568–1573 (1986).

Ghofraniha, Mehrdad and R. Salovey, Polymer Engineering and Science, Electrical Conductivity of Polymers Containing Carbon Black, vol. 28, No. 1, pp. 5863 (Mid–Jan., 1988).

Yacubowicz, J. and M. Narkis, Polymer Engineering and Science, Electrical and Dielectric Properties of Segregated Carbon Black–Polyethylene Systems, vol. 30, No. 8, pp. 459–468 (Apr., 1990).

Lee, Biing–lin, Polymer Engineering and Science, Electrically Conductive Polymer Composites and Blends, vol. 32, No. 1, pp. 36–42 (Mid–Jan., 1992).

Al–Allak, H.M., A.W. Brinkman and J. Woods, Journal of Materials Science, I–V Characteristics of Carbon Black–Loaded Crystalline Polyethylene, vol. 28, pp. 117–120 (1993).

Tang, Hao et al., Temperature Coefficient of Vinyl Polymer/CB, The Positive Temperature Coefficient Phenomenon of Vinyl Polymer/CB Composites, pp. 1795–1800.

Gubbels, F. et al., Macromolecules, Design of Electrical Conductive Composites: Key Role of the Morphology on the Electrical Properties of Carbon Black Filled Polymer Blends, vol. 28, pp. 1559–1566 (1995).

Tang, Hao et al., Carbon Black Polymers, Studies on the Electrical Conductivity of Carbon Black Filled Polymers, pp. 383–387.

POLYMERIC PTC COMPOSITIONS

CROSS REFERENCE TO RELATED APPLICATION

This application claims the benefit of U.S. Provisional Application No. 60/004,600, filed Sep. 29,1995.

TECHNICAL FIELD

The present invention relates to electrical circuit protection devices comprising conductive polymer compositions which exhibit PTC behavior.

BACKGROUND OF THE INVENTION

It is well known that the resistivity of many conductive materials change with temperature. The resistivity of a positive temperature coefficient (PTC) conductive material sharply increases as the temperature of the material increases over a particular range. Many crystalline polymers, made electrically conductive by dispersing conductive fillers therein, exhibit this PTC effect. These polymers generally include polyolefins such as polyethylene, polypropylene and ethylene/propylene copolymers. At temperatures below a certain value, i.e., the critical or trip temperature, the polymer exhibits a relatively low, constant resistivity. However, as the temperature of the polymer increases beyond the critical point, the resistivity of the polymer sharply increases. Compositions exhibiting PTC behavior have been used in electrical devices as over-current protection in electrical circuits comprising a power source and additional electrical components in series. Under normal operating conditions in the electrical circuit, the resistance of the load and the PTC device is such that relatively little current flows through the PTC device. Thus, the temperature of the device (due to $I^2R$ heating) remains below the critical or trip temperature. If the load is short circuited or the circuit experiences a power surge, the current flowing through the PTC device increases greatly. At this point, a great deal of power is dissipated in the PTC device. This power dissipation only occurs for a short period of time (fraction of a second) , however, because the power dissipation will raise the temperature of the PTC device (due to $I^2R$ heating) to a value where the resistance of the PTC device has become so high, that the current is limited to a negligible value. The new current value is enough to maintain the PTC device at a new, high temperature/high resistance equilibrium point. The device is said to be in its "tripped" state. The negligible or trickle through current that flows through the circuit will not damage the electrical components which are connected in series with the PTC device. Thus, the PTC device acts as a form of a fuse, reducing the current flow through the short circuit load to a safe, low value when the PTC device is heated to its critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

Conductive polymer PTC compositions and their use as protection devices are well known in the industry. For example, U.S. Pat. No. 4,237,441 (Van Konynenburg et al.), 4,304,987 (Van Konynenburg), U.S. Pat. No. 4,545,926 (Fouts, Jr. et al.), U.S. Pat. No. 4,849,133 (Yoshida et al.), U.S. Pat. No. 4,910,389 (Sherman et al.), and U.S. Pat. No. 5,106,538 (Barma et al.) disclose PTC compositions which comprise a thermoplastic crystalline polymer with carbon black dispersed therein. Conventional polymer PTC electrical devices include a PTC element interposed between a pair of electrodes. The electrodes can be connected to a source of power, thus, causing electrical current to flow through the PTC element.

However, in prior conductive polymer PTC compositions and electrical devices employing such compositions, the polymer PTC composition has been susceptible to the effects of oxidation and changes in resistivity at high temperatures or high voltage applications. This thermal and electrical instability is undesirable, particularly when the circuit protection device is exposed to changes in the ambient temperature, undergoes a large number of thermal cycles, i.e., changes from the low resistant state to the high resistant state, or remains in the high resistant (or "tripped") state for long periods of time.

Further, in electrical devices employing prior conductive polymer PTC compositions, poor physical adhesion (i.e., poor ohmic contact) between the PTC composition and the electrodes has resulted in an increased contact resistance. As a result, PTC devices employing these prior compositions have had high initial or room temperature resistances, thus, limiting their applications. Attempts to overcome this poor ohmic contact in prior PTC devices have generally focused on changes to the electrode design. For example, U.S. Pat. No. 3,351,882 (Kohler et al.) discloses a resistive element composed of a polymer having conductive particles dispersed therein and electrodes of meshed construction (e.g., wire screening, wire mesh, spaced apart wire strands, or perforated sheet metal) embedded in the polymer. Japanese Patent Kokai No. 5-109502 discloses an electrical circuit protection device comprising a PTC element and electrodes of a porous metal material having a three-dimensional network structure.

Other attempts at improving ohmic contact in PTC devices have included chemically or mechanically treated electrodes to provide a roughened surface. For example, U.S. Pat. Nos. 4,689,475 and 4,800,253 (Kleiner et al.), and Japanese Patent No. 1,865,237 disclose metal electrodes having chemically or mechanically treated surfaces to enhance surface roughness. These treatments include electrodeposition, etching, galvanic deposition, rolling or pressing. These treatments, however, increase the number of processing steps and increase the overall cost of the PTC device.

SUMMARY OF THE INVENTION

It is an object of the present invention to provide a conductive polymer PTC composition with improved electrical and thermal stability. It is a further object of the present invention to provide a conductive polymer PTC composition which exhibits excellent adhesion to metal electrodes having smooth surfaces. Accordingly, a circuit protection device can be provided whose resistance returns essentially to its initial value or lower even after repeated cycling (i.e., going from its low resistant state to its high resistant state and back again) and prolonged periods in its "tripped" state. The improved adhesion and the electrical and thermal stability of the conductive polymer PTC composition of the present invention also broaden the range of applications in which an electrical circuit protection device may be used.

Accordingly, in one aspect of the present invention there is provided a crystalline conductive polymer composition exhibiting PTC behavior. The composition comprises a modified polyolefin and a conductive particulate filler. Unlike prior conductive polymer PTC compositions where the conductive particulate filler is uniformly dispersed within a crystalline polymer matrix, the conductive particulate filler of the present invention is chemically bonded, i.e., grafted, to the modified polyolefin.

In another aspect of the present invention, there is provided a crystalline conductive polymer composition exhibiting PTC behavior. The composition comprises a conductive particulate filler and a modified polyolefin having the formula

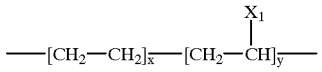

wherein $X_1$ is selected from the group consisting of carboxylic acids and carboxylic acid derivatives, and wherein x and y are present in an amount such that the ratio by weight of x/y is at least 9.

In another aspect of the present invention, there is provided a crystalline conductive polymer composition which exhibits PTC behavior and has a resistivity at 25° C. of less than 5 ohm cm and a peak resistivity at a temperature greater than 25° C. of at least 1,000 ohm cm. The composition comprises a conductive filler component grafted to a modified polyolefin component.

The present invention also provides an electrical device comprising:

(a) a PTC element having a modified polyolefin component grafted to a conductive particulate filler component; and (b) two electrodes, each electrode being connectable to a source of power, and when so connected, causing current to flow through the PTC element.

In another aspect, the present invention provides an electrical device comprising:

(a) a PTC element having a modified polyolefin component grafted to a conductive particulate filler component, the modified polyolefin component comprised of about 90–99% by weight polyethylene and about 1–10% by weight carboxylic acid or a carboxylic acid derivative, the PTC element having a resistivity at 25° C. of less than 5 ohm cm and a peak resistivity at a temperature greater than 25° C. of at least 1,000 ohm cm; and (b) two electrodes, each electrode being connectable to a source of power, and when so connected, causing current to flow through the PTC element, the electrical device having a resistance, $R_{int}$, at 25° C. of less than 1 ohm.

The present invention also provides an electrical device comprising:

(a) a PTC element having a modified polyolefin component grafted to a conductive particulate filler component; and (b) two electrodes having a surface roughness, $R_a$, the electrodes not being chemically or mechanically treated to enhance the surface roughness, $R_a$, each electrode being connectable to a source of power, and when so connected, causing current to flow through the PTC element.

In yet another aspect of the present invention, there is provided an electrical circuit comprising:

(a) a source of electrical power;

(b) a circuit protection device comprising a PTC element and two electrodes, the PTC element being composed of a conductive polymer composition comprising a modified polyolefin and a conductive particulate filler; and (c) other circuit elements connected in series with the circuit protection device which have a resistance $R_L$ ohms.

In a final aspect of the present invention there is provided an electrical circuit which includes a source of electrical power, a circuit protection device comprising a PTC element and two electrodes, and other circuit elements connected in series with the circuit protection device which have a resistance $R_L$ ohms, and which has a normal operating condition and a high temperature stable operating condition at the occurrence of a fault condition, wherein:

(a) the PTC element is composed of a PTC conductive polymer comprising an organic polymer material and conductive carbon black, the PTC conductive polymer having a resistivity at 25° C. of 5 ohm cm or less;

(b) the circuit protection device having a resistance at 25° C. of 1 ohm or less and $0.5 \times R_L$ ohm or less;

(c) the ratio of the power in the circuit in the normal operating condition to the power in the high temperature stable operating condition, i.e., the Switching Ratio, is at least 8;

the improvement comprising the organic polymer material being comprised of a modified polyolefin having the formula

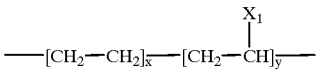

wherein $X_1$ is selected from the group consisting of carboxylic acids and carboxylic acid derivatives, and wherein x and y are present in an amount such that the ratio by weight of x/y is at least 9.

Other advantages and aspects of the present invention will become apparent upon reading the following description of the drawings and detailed description of the invention.

DETAILED DESCRIPTION

Figure 1:
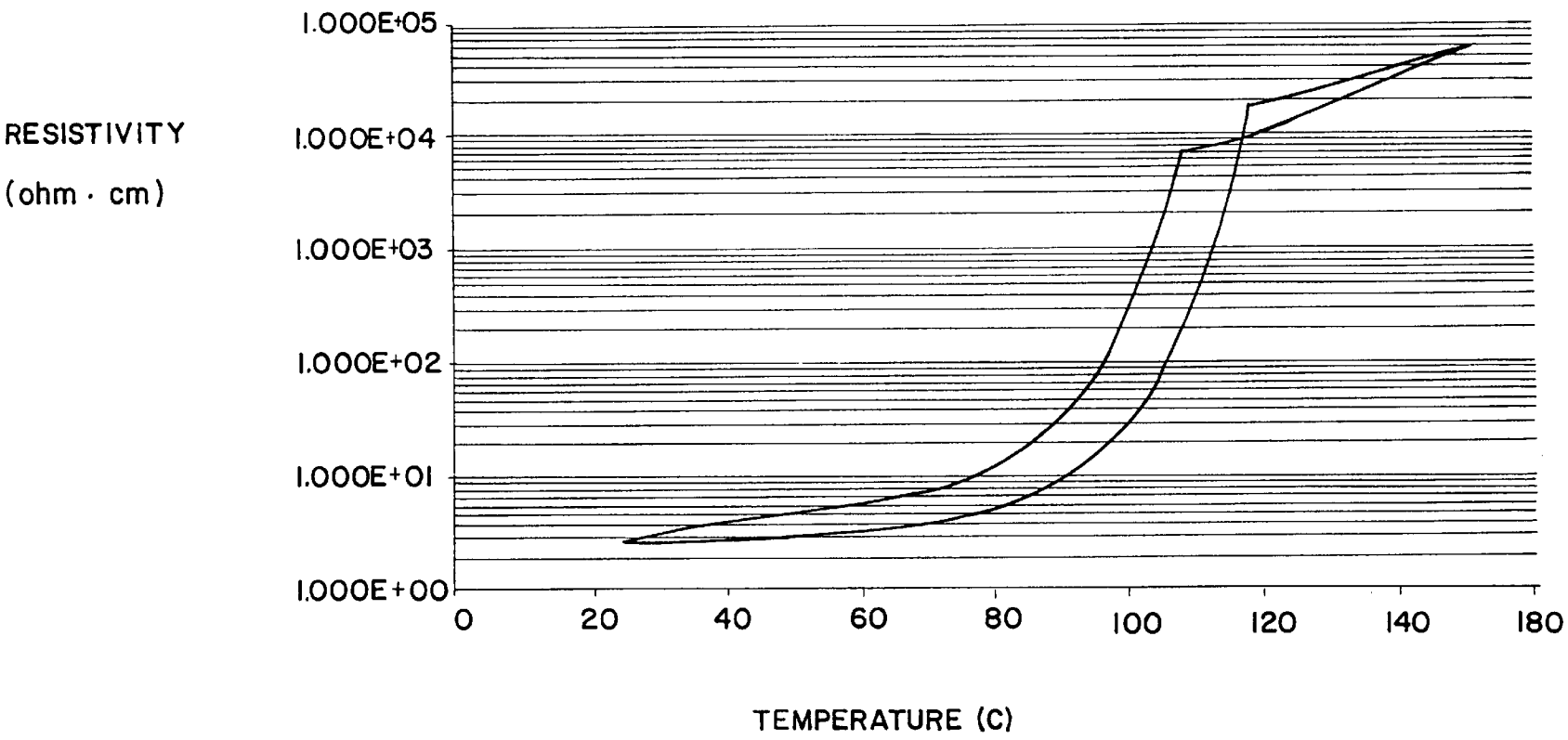
FIG. 1 illustrates the resistivity as a function of temperature of a first embodiment of the present invention.

While this invention is susceptible of embodiment in many different forms, there is shown in the drawings and will herein be described in detail preferred embodiments and methods of manufacture with the understanding that the present disclosure is to be considered as an exemplification of the principles of the invention and is not intended to limit the broad aspect of the invention to the embodiments illustrated.

The polymer component used in the present invention may be a modified polyolefin. The term modified polyolefin as used herein is defined as a polyolefin having a carboxylic acid or a carboxylic acid derivative grafted thereto. The carboxylic acid or the carboxylic acid derivative can comprise as much as 10% by weight of the modified polyolefin, preferably 5% by weight of the modified polyolefin, more preferably 3% by weight of the modified polyolefin, especially 1% by weight of the modified polyolefin. Polyolefins used in the present invention should have a crystallinity of at least 30%, preferably more than 70%. Suitable polyolefins include polyethylene, copolymers of polyethylene, polypropylene, ethylene/propylene copolymers, polybutadiene, polyethylene acrylates, and ethylene acrylic acid copolymers.

Carboxylic acids have the general formula

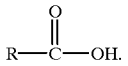

Suitable carboxylic acids for use in the present invention include formic acid, acetic acid, propionic acid, butyric acid, valeric acid, caproic acid, caprylic acid, capric acid, lauric acid, myristic acid, palmitic acid, stearic acid, oxalic acid, malonic acid, succinic acid, glutaric acid adipic acid, and maleic acid.

A carboxylic acid derivative can be substituted for carboxylic acid in the modified polyolefin component and also yield a conductive polymer PTC composition with improved electrical and thermal stability. Thus, for purposes of the present invention, it is understood that carboxylic acids and their derivatives are equivalent. Suitable carboxylic acid derivatives for use in the present invention include:
carboxylic esters having the general formula

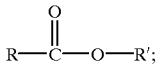

carboxylic anhydrides having the general formula

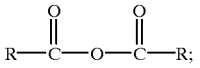

acyl chlorides having the general formula

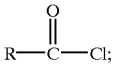

amides having the following general formulas

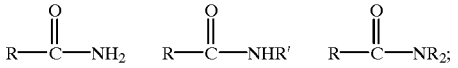

and, thiol esters having the general formula

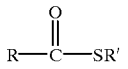

Suitable conductive particulate fillers for use in the present invention include nickel powder, silver powder, gold powder, copper powder, silver-plated copper powder, powders of metal alloys, carbon black, carbon powder, and graphite.

The amount of conductive particulate filler in the present invention should be such that the conductive polymer composition exhibits PTC behavior and has: (1) an initial resistivity at 25° C. of less than 5 ohm cm, preferably less than 2 ohm cm and especially less than 1 ohm cm; and, (2) a peak resistivity of at least 1,000 ohm cm, preferably at least 10,000 ohm cm and especially at least 100,000 ohm cm. Generally, compositions of the present invention will have a volume ratio of conductive particulate filler to modified polyolefin of at least 0.30, preferably at least 0.50 and especially at least 0.60.

In the present invention, the conductive particulate filler can be grafted to the modified polyolefin via an esterification reaction. It has been found that the conductive particulate fillers previously mentioned, and particularly carbon black, carbon powder and graphite have a hydroxyl group, represented by the general formula —OH, attached to the surface. The oxygen atom of the hydroxyl group is divalent and, therefore, forms two bonds; one with the hydrogen atom and one with the surface of the conductive particulate filler. As a result, the oxygen atom has two pairs of unbonded electrons. Due to these unbonded electrons, the oxygen atom is electronegative in nature. Consequently, the oxygen atom has an affinity for electropositive atoms.

The polyolefin component which is modified with a carboxylic acid, or a derivative thereof, is characterized by having a carbonyl group, represented by the general formula C═O. Due to the double bond of the carbonyl group, the carbon atom is electropositive in nature.

The esterification reaction is a thermally activated chemical reaction. Upon subjecting a mixture of the modified polyolefin and the conductive particulate filler to heat and mechanical shear, a new carbon-oxygen bond is formed due to the affinity of the oxygen atom of the hydroxyl group for the carbon atom of the carbonyl group. Consequently, the conductive particulate filler is chemically bonded (i.e., grafted) to the modified polyolefin component.

The esterification reaction can be illustrated with reference to a preferred embodiment. In a preferred embodiment of the present invention, the modified polyolefin comprises high density polyethylene grafted with maleic anhydride. Such a polymer is available from Du Pont under the tradename Fusabond™. The method for manufacturing such a polymer is also disclosed in U.S. Pat. No. 4,612,155 (wong et al.). The preferred conductive particulate filler of the present invention is carbon black. The esterification reaction which grafts the carbon black to the modified polyethylene (maleic anhydride grafted polyethylene) can be represented according to the formula below:

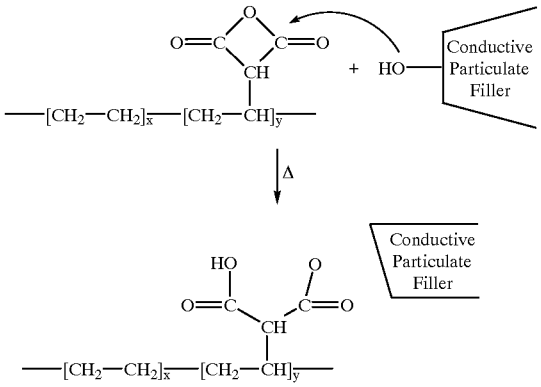

Figure 3:
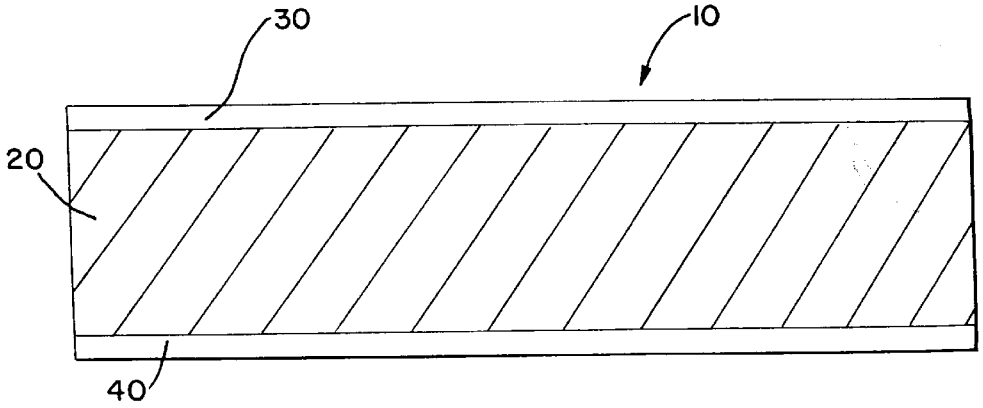
FIG. 3 illustrates a side view of an electrical device of the present invention.

With reference to FIG. 3, electrical devices 10 of the present invention comprise a PTC element 20 having a modified polyolefin component grafted to a conductive particulate filler component. The PTC element 20 has a first surface affixed to a first electrode 30 and second surface affixed to a second electrode 40. The electrodes 30 and 40 can be connected to a source of power, and when so connected, cause current to flow through the PTC element 20.

EXAMPLE 1

A quantity of 121.15 g of modified polyolefin comprised of 99% by weight high density polyethylene and 1% by weight maleic anhydride (manufactured by Du Pont under the tradename Fusabond 'E' MB-100D) having a specific gravity of 0.90–0.96 and a melt temperature of approximately 130° C. was placed in a C.W. Brabender Plasti-Corder PL 2000 equipped with a Mixer-Measuring Head and fluxed at 200° C. for approximately 5 minutes at 5 rpm. A quantity of 118.85 g carbon black (manufactured by Columbian Chemicals under the tradename Raven 450) was incorporated into the fluxed modified polyolefin and mixed for 5 minutes at 5 rpm. The speed of the Brabender mixer was then increased to 80 rpm, and the modified polyolefin and carbon black were thoroughly mixed at 200° C. for 5 minutes. The energy input, due to the mixing, caused the temperature of the composition to increase to 240° C.

The increased temperature of the composition allowed the esterification reaction, as previously described, to take place between the modified polyolefin and the carbon black. As a result, the carbon black is grafted to the modified polyolefin.

After allowing the composition to cool, the composition was then placed into a C.W. Brabender Granu-Grinder where it was ground into small chips. The chips were then fed into the C.W. Brabender Plasti-Corder PL 2000 equipped with an Extruder Measuring Head. The extruder was fitted with a die having an opening of 0.002 inch, and the belt speed of the extruder was set at 2. The temperature of the extruder was set at 200° C., and the screw speed of the extruder was measured at 50 rpm. The chips were extruded into a sheet approximately 2.0 inches wide by 8 feet long. This sheet was then cut into a number of 2 inch×2 inch sample PTC elements, and pre-pressed at 200° C. to a thickness of approximately 0.01 inch.

A sample PTC element was laminated between two metal foil electrodes in a heated press. The metal foil electrodes were treated to provide an average surface roughness, $R_a$, of approximately 1.2–1.7 microns. Such foils are available from Fukuda Metal Foil & Powder Co., Ltd. under the tradename NiFT-25. After the laminate was removed from the press and allowed to cool without further pressure, the laminate was sheared into a number of 0.15 inch×0.18 inch electrical devices. The resistance at 25° C. of ten electrical devices made according to Example 1 is listed below in Table I.

TABLE I

| SAMPLE | INITIAL RESIST (OHMS) |
|---|---|
| 1 | 1.2096 |
| 2 | 1.9092 |
| 3 | 1.8404 |
| 4 | 2.7570 |
| 5 | 2.6320 |
| 6 | 2.2970 |
| 7 | 2.4740 |
| 8 | 2.1130 |
| 9 | 2.2610 |
| 10 | 2.8110 |
| AVERAGE | 2.2304 |

EXAMPLE 2

A second composition was produced in substantially the same manner as that of Example 1 except that the initial components comprised a quantity of 108.15 g of modified polyolefin (manufactured by Du Pont under the tradename Fusabond 'E' MB-226D) having a specific gravity of 0.90–0.96 and a melt temperature of approximately 130° C. and 131.85 g of carbon black (manufactured by Columbian Chemicals under the tradename Raven 430). The resistivity of the composition as a function of temperature is illustrated in FIG. 1. The composition had an initial resistivity at 25° C. of 2.8 ohm cm and a peak resistivity at approximately 120° C. of $1.9\times10^4$ ohm cm.

The procedure set forth in Example 1 was followed to produce a number of 0.15 inch×0.18 inch electrical devices. The resistance at 25° C. of ten electrical devices made according to Example 2 is listed below in Table II.

TABLE II

| SAMPLE | INITIAL RESIST (OHMS) |
|---|---|
| 1 | 0.6786 |
| 2 | 0.6092 |
| 3 | 0.6669 |
| 4 | 0.6607 |
| 5 | 0.6340 |
| 6 | 0.6306 |
| 7 | 0.6431 |
| 8 | 0.6761 |
| 9 | 0.6398 |
| 10 | 0.6723 |
| AVERAGE | 0.6511 |

EXAMPLE 3

Figure 2:
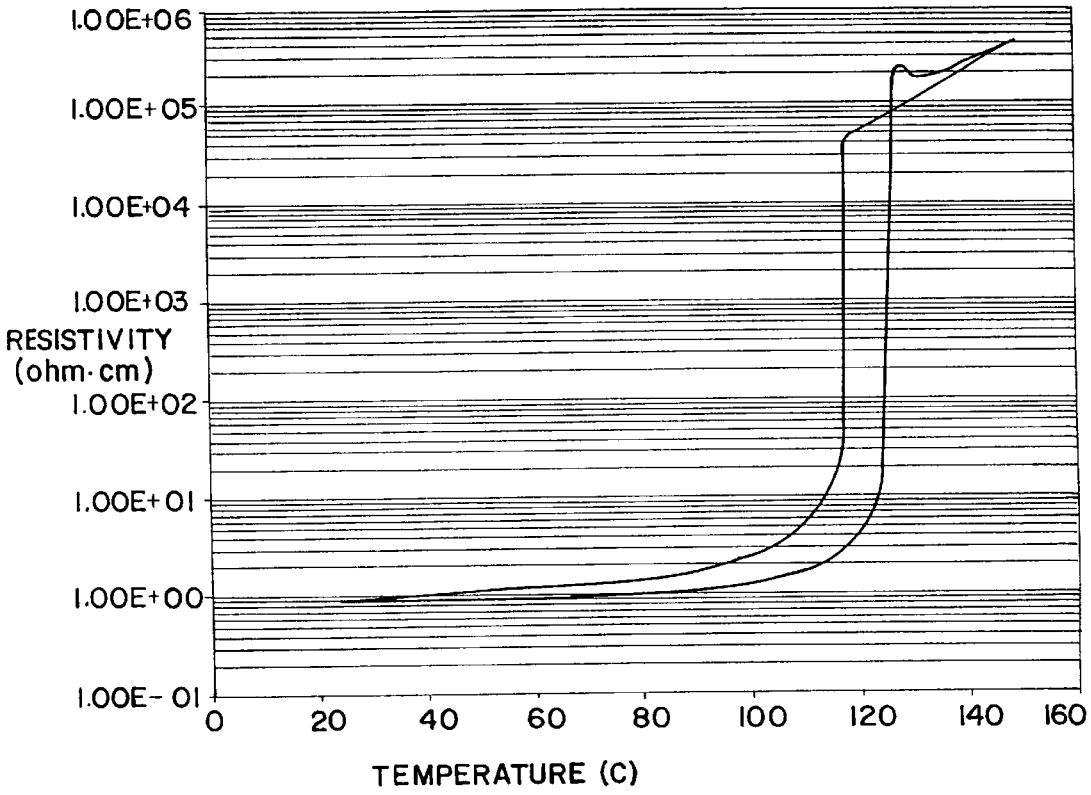
FIG. 2 illustrates the resistivity as a function of temperature of a second embodiment of the present invention.

A third composition was produced in substantially the same manner as that of Example 1 except that the initial components comprised a quantity of 111.96 g of modified polyolefin (manufactured by Du Pont under the tradename Fusabond 'E' MB-100D) having a specific gravity of 0.90–0.96 and a melt temperature of approximately 130° C. and 128.04 g of carbon black (manufactured by Columbian Chemicals under the tradename Raven 430). The resistivity of the composition as a function of temperature is illustrated in FIG. 2. The composition had an initial resistivity at 25° C. of 0.8 ohm cm and a peak resistivity at approximately 120° C. of $5.1\times10^5$ ohm cm.

The procedure set forth in Example 1 was followed to produce a number of 0.15 inch×0.18 inch electrical devices. The resistance at 25° C. of ten electrical devices made according to Example 3 is listed below in Table III.

TABLE III

| SAMPLE | INITIAL RESIST (OHMS) |
|---|---|
| 1 | 0.1268 |
| 2 | 0.1181 |
| 3 | 0.1169 |
| 4 | 0.1143 |
| 5 | 0.1196 |
| 6 | 0.1183 |
| 7 | 0.1202 |
| 8 | 0.1213 |
| 9 | 0.1240 |
| 10 | 0.1240 |
| AVERAGE | 0.1203 |

Laboratory tests have shown that PTC compositions of the present invention also adhere extremely well to smooth foils. Accordingly, conventional metal foils having surfaces that are not chemically or mechanically treated to enhance their surface roughness can also be used as electrodes in electrical devices of the present invention.

EXAMPLE 4

A fourth composition was produced using a Leistritz twin screw extruder compounding system, Model ZSE-27. A composition comprising 50.80% by weight modified polyethylene (manufactured by Du Pont under the tradename Fusabond 'E' MB-100D, having a specific gravity of 0.90–0.96 and a melt temperature of approximately 130° C.) and 49.20% by weight carbon black (manufactured by Columbian Chemicals under the tradename Raven 430) was placed in a gravimetric feeder and fed to the Leistritz melt/mix/pump system. The processing conditions for the compounding system were as follows: melt temperature, 239° C.; screw speed, 120 rpm; screw configuration, co-rotating; melt pressure, 2100 p.s.i.; and line speed 6.45 feet per minute.

A sample PTC element was extruded to a thickness of 0.011 inch and laminated between two metal foil electrodes in a heated press. The metal foil electrodes were not chemically or mechanically treated to enhance their surface roughness, and thus, had an average surface roughness, $R_a$, of approximately 0.3–0.5 microns. After the laminate was removed from the press and allowed to cool without further pressure, the laminate was sheared into a number of 0.15 inch×0.18 inch electrical devices. The composition of Example 4 had a resistivity at 25° C. of 1.54 ohm cm and a peak resistivity at a temperature greater than 25° C. of $2.4\times10^7$ ohm cm.

The electrical and thermal stability and the ohmic contact of devices made according to Example 4 were tested by subjecting the devices to cycle life and trip endurance tests. The cycle life test consisted of applying a current of 40 amps to the device for a period of 15 seconds, followed by a resting period of no current or voltage for 285 seconds. This comprised one cycle. The device was cycled 100 times, with the resistance of the device being measured after cycles 1, 2, 10 and 100. The results of cycle life tests for 10 devices made according to Example 4 are illustrated in Table IV A below. The devices tested had an average change in resistance after 100 cycles of −5.05%.

TABLE IV

A

| Sample Number | Initial Resistance (Ohms) | Resistance After 1 Cycle (Ohms) | Resistance After 2 Cycles (Ohms) | Resistance After 10 Cycles (Ohms) | Resistance After 100 Cycles (Ohms) |
|---|---|---|---|---|---|
| 1 | 0.3255 | 0.2638 | 0.2516 | 0.2131 | 0.3592 |
| 2 | 0.3367 | 0.2709 | 0.2597 | 0.2188 | 0.3178 |
| 3 | 0.3212 | 0.2578 | 0.2459 | 0.2065 | 0.3036 |
| 4 | 0.3588 | 0.2869 | 0.2738 | 0.2311 | 0.4110 |
| 5 | 0.3314 | 0.2650 | 0.2527 | 0.2109 | 0.2974 |
| 6 | 0.3365 | 0.2707 | 0.2578 | 0.2173 | 0.3514 |
| 7 | 0.3636 | 0.2962 | 0.2843 | 0.2391 | 0.2903 |
| 8 | 0.3434 | 0.2804 | 0.2681 | 0.2236 | 0.3018 |
| 9 | 0.3484 | 0.2858 | 0.2730 | 0.2290 | 0.2721 |
| 10 | 0.3636 | 0.2968 | 0.2847 | 0.2379 | 0.3478 |

The trip endurance test consisted of initially tripping the device using a 40 amp current for a maximum duration of 15 seconds. The device was then held in the tripped state by switching to and maintaining 15 volts across the device. The resistance of the device was measured after 1, 24, 48 and 168 cumulative hours. The results of the trip endurance test for 10 devices made according to Example 4 are illustrated in Table IV B below. The devices tested had a average change in resistance of −13.06% after spending 168 hours in the tripped state.

TABLE IV

B

| Sample Number | $R_{int}$ (ohms) | $R_{1\ hr\ trip}$ (ohms) | $R_{24\ hr\ trip}$ (ohms) | $R_{48\ hr\ trip}$ (ohms) | $R_{168\ hr\ trip}$ (ohms) |
|---|---|---|---|---|---|
| 1 | 0.3463 | 0.2413 | 0.2590 | 0.2652 | 0.3217 |
| 2 | 0.3387 | 0.2372 | 0.2507 | 0.2489 | 0.2904 |
| 3 | 0.3663 | 0.2481 | 0.2628 | 0.2641 | 0.3138 |
| 4 | 0.3367 | 0.2356 | 0.2572 | 0.2575 | 0.3089 |
| 5 | 0.3258 | 0.2248 | 0.2389 | 0.2385 | 0.2838 |
| 6 | 0.3277 | 0.2249 | 0.2394 | 0.2369 | 0.2729 |
| 7 | 0.3217 | 0.2227 | 0.2441 | 0.2420 | 0.2818 |
| 8 | 0.3321 | 0.2305 | 0.2480 | 0.2465 | 0.2865 |
| 9 | 0.3511 | 0.2441 | 0.2649 | 0.2620 | 0.3037 |
| 10 | 0.3664 | 0.2513 | 0.2642 | 0.2624 | 0.3026 |

Figure 4:
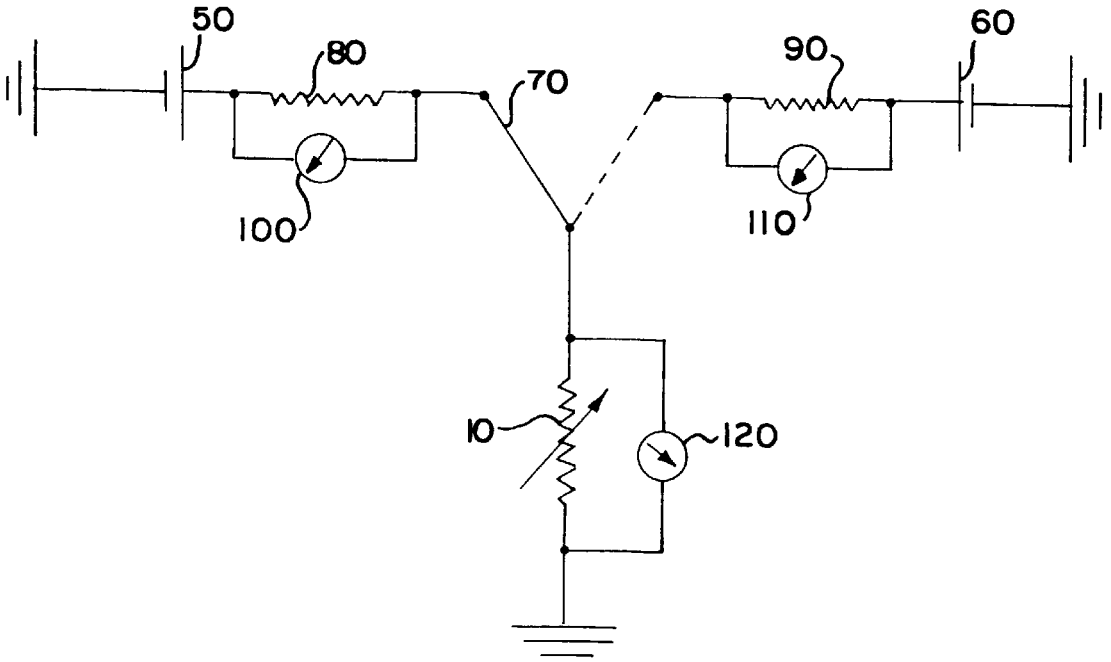
FIG. 4 illustrates a test circuit used to measure the dielectric strength of circuit protection devices according to the present invention; and, FIG. 5 illustrates an application of the present invention as a circuit protection device in a typical electrical circuit.

Circuit protection devices made according to Example 4 of the present invention were also incorporated into a test circuit to measure the voltage breakdown and dielectric strength. The test circuit is illustrated in FIG. 4. The circuit was supplied with a 30 volt/10 amp DC power source (reference numeral 50 in FIG. 4) and an alternate 600 volt/1.5 amp DC power source (reference numeral 60). A relay switch 70 was used to alternate between power sources 50 and 60. The device 10 was connected in series with the power source. A 10 amp shunt (reference numeral 80) was placed in series with the 30 volt/10 amp power supply, while a 1 amp shunt (reference numeral 90) was placed in series with the 600 volt/1.5 amp power supply. For safety reasons, a 3 amp fuse was connected in series with the 600 volt/1.5 amp power supply. A FLUKE™ digital multimeter 100, 110 was placed in parallel with each shunt. At different times, the current through the device was measured by the voltage drop across either shunt. A FLUKE™ digital multimeter 120 was also placed in parallel with the PTC device.

Under passive conditions, where power in the device is zero, the initial resistance of the device, $R_{int}$, was measured at 20° C. The voltage drop across the device was measured directly by multimeter 120, while the current through the device was calculated from the voltage drop across shunt 80. Under active conditions, where the power in the device is greater than zero, the resistance of the device was calculated from the voltage/current measurements.

The maximum current through the device, $I_{max}$, was determined by increasing the 30 volt/10 amp power source to $V_{trip}$, a level where any further increase in voltage resulted in a decrease in current. At this point, with the device in the tripped state (i.e., high temperature, high resistance stable equilibrium point), the relay was switched to the 600 volt/1.5 amp DC power supply in order to increase the applied voltage across the device. The voltage breakdown, $V_{max}$, was determined by slowly increasing the voltage applied to the tripped device until dielectric breakdown occurred. The dielectric strength in volts/mm was calculated by dividing the voltage breakdown, $V_{max}$, by the thickness of the PTC element. The maximum voltage breakdown, $R_{int}$, $I_{max}$, and dielectric strength for five electrical devices made according to Example 4 of the present invention are shown below in Table IV C. The devices tested had an average dielectric strength of 1116.68 volts/mm.

TABLE IV

| | | C | | |
|---|---|---|---|---|
| Sample Number | Voltage Breakdown $V_{max}$ (volts) | Device Resistance at 20° C. $R_{int}$ (ohms) | Maximum Pass Current $I_{max}$ (amp) | Dielectric Strength (V/mm) |
| 1 | 300 | 0.3706 | 1.53 | 1071.4 |
| 2 | 340 | 0.3510 | 1.54 | 1214.3 |
| 3 | 280 | 0.3315 | 1.63 | 1000.0 |
| 4 | 330 | 0.3561 | 1.54 | 1178.6 |
| 5 | 310 | 0.3581 | 1.48 | 1107.1 |

EXAMPLE 5

Figure 5:
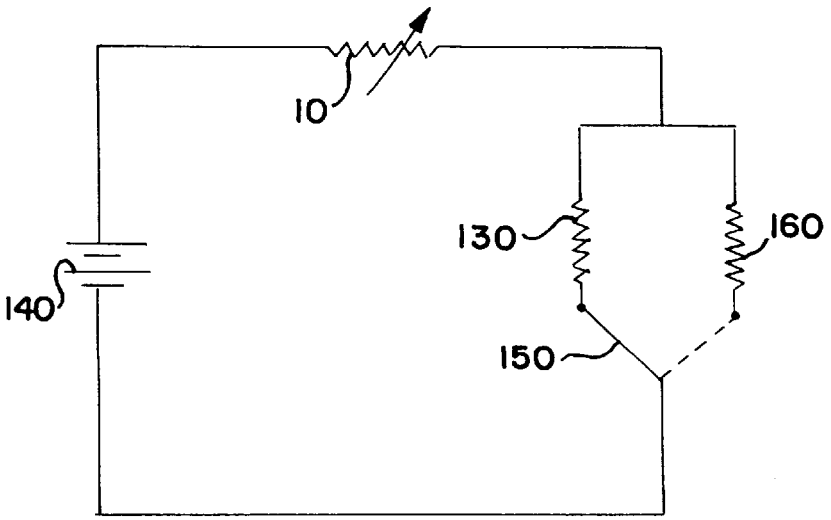

With reference to FIG. 5, the following illustrates a typical application of the present invention as a circuit protection device. A device 10 made according to Example 4 was placed in a circuit consisting of the PTC device 10, a resistive load (reference numeral 130) of 27.3 ohms in series with the device, and a 30 volt D.C. power supply 140. The resistance of the PTC device at 25° C. was 0.365 ohms. A relay switch 150 was placed in the series circuit to simulate short circuit conditions by switching from the 27.3 ohm resistive load to a 1 ohm resistive load (reference numeral 160).

Under normal operating conditions, the current in the circuit was 1.1 amp. The voltage drop across the PTC device was 0.418 volts while the power in the circuit was 33.49 watts. To simulate short circuit conditions, the relay was switched to the 1 ohm resistive load so that the 1 ohm load was in series with the PTC device and the 30 volt power supply. Initially, there was a very substantial increase in current flowing in the circuit. However, due to $J^2R$ heating, the temperature of the PTC device rose to its critical temperature and the resistance of the PTC device greatly increased. At this high temperature stable equilibrium point, the PTC device had a resistance of 545 ohms while the current flowing through the circuit was cut to 0.055 amp. The power in the circuit decreased to 1.65 watts. The Switching Ratio, i.e., the ratio of power in the circuit in the normal operating condition to the power in the circuit at the high temperature stable equilibrium point was 33.49 watts/1.65 watts or 20.29.

While the specific embodiments have been illustrated and described, numerous modifications come to mind without markedly departing from the spirit of the invention. The scope of protection is only intended to be limited by the scope of the accompanying claims.

I claim:

1. A crystalline conductive polymer composition exhibiting PTC behavior, the composition comprising a single polymer component and a conductive particulate filler component, the single polymer component consisting essentially of a modified polyolefin composed of high density polyethylene and maleic anhydride, the composition being prepared by mixing and extruding the polymer component and the conductive filler component to form an extrudate wherein the modified polyolefin is grafted to the conductive particulate filler component and the extrudate has an electrical resistivity at approximately 25° C. of less than 2 ohm cm.

2. The composition of claim 1, wherein the modified polyolefin comprises about 90–99% by weight polyethylene and 1–10% by weight maleic anhydride.

3. The composition of claim 1, wherein the conductive particulate filler comprises carbon black.

4. The composition of claim 1, wherein the conductive particulate filler forms a chemical bond with the modified polyolefin.

5. The composition of claim 1, wherein the composition has a peak resistivity at a temperature greater than 25° C. of at least 100,000 ohm cm.

6. A crystalline conductive polymer composition exhibiting PTC behavior, the composition being prepared by mixing ad extruding the conductive polymer composition to form an extrudate having an electrical resistivity at approximately 25° C. of less than 2 ohm cm and a peak resistivity greater than 100,000 ohm cm, the extrudate comprising a conductive particulate filler grafted to a single polymer component consisting essentially of a modified polyolefin having the formula $$-[CH_2-CH_2]_x-[CH_2-\overset{X_1}{CH}]_y- ,$$

wherein $X_1$ is selected from the group consisting of carboxylic acids and carboxylic acid derivatives, and wherein x and y are present in an amount such that the ratio by weight of x/y is at least 9.

7. The composition of claim 6, wherein $X_1$ comprises a carboxylic acid derivative selected from the group consisting of acyl chlorides, carboxylic anhydrides, carboxylic esters, amides, and thiol esters.

8. The composition of claim 6, wherein $X_1$ is maleic anhydride.

9. The composition of claim 6, wherein the ratio by volume of the conductive particulate filler to the modified polyolefin having the formula $$-[CH_2-CH_2]_x-[CH_2-\overset{X_1}{\overset{|}{CH}}]_y-$$

is at least 0.30.

10. A conductive polymer composition having a resistivity at 25° C. of less than 2 ohm cm and a peak resistivity at a temperature greater than 25° C. of at least 100,000 ohm cm, the composition comprising a conductive filler component and a single polymer component consisting essentially of a modified polyolefin, the composition having been mixed and extruded at a temperature greater than 200° C. such that the conductive filler component is grafted to the modified polyolefin.

11. The composition of claim 10, wherein the modified polyolefin component comprises:

(a) a polyolefin selected from the group consisting of polyethylene, polyethylene copolymers, polypropylene and ethylene/propylene copolymers; and, (b) a carboxylic acid or a carboxylic acid derivative.

12. The composition of claim 11, wherein the carboxylic acid derivative comprises a derivative selected from the group consisting of acyl chlorides, carboxylic anhydrides, carboxylic esters, amides, and thiol esters.

13. The composition of claim 10, wherein the modified polyolefin component comprises polyethylene and maleic anhydride.

14. The composition of claim 14, wherein the modified polyolefin component comprises about 90–99% by weight polyolefin and about 1–10% by weight carboxylic acid or a carboxylic acid derivative.

15. The composition of claim 10, wherein the composition comprises about 30–45% by volume conductive filler component and about 55–70% by volume polymer component.

16. A crystalline conductive polymer composition exhibiting PTC behavior, the composition comprising a single polymer component consisting essentially of a modified polyolefin and a conductive particulate filler, the composition having a resistivity at 25° C. of less than 2 ohm cm and a dielectric strength of at least 1,000 V/mm.

17. The composition of claim 16, having an electrical resistivity at approximately 25° C. of less than 1 ohm cm and a peak resistivity at a temperature greater than 25° C. of greater than 100,000 ohm cm.

* * * * *

UNITED STATES PATENT AND TRADEMARK OFFICE

CERTIFICATE OF CORRECTION

PATENT NO. : 6,059,997
DATED : May 9, 2000
INVENTOR(S) : Tom J. Hall

It is certified that error appears in the above-identified patent and that said Letters Patent is hereby corrected as shown below:

Column 11:
Line 34, delete "$J^2R$" and insert --$I^2R$--

Column 12:
Line 9, change "ad" to --and--
Line 16-18 change $$\overset{X_1}{\text{—[CH}_2\text{—CH}_2\text{]}_x\text{—[CH}_2\text{—CH]}_y\text{—}}$$

to $$\text{—[CH}_2\text{—CH}_2\text{]}_x\text{—[CH}_2\text{—}\overset{X_1}{\overset{|}{\text{CH}}}\text{]}_y\text{—}$$

Signed and Sealed this

Seventh Day of August, 2001

Nicholas P. Godici

*Attest:*

*Attesting Officer*

NICHOLAS P. GODICI
*Acting Director of the United States Patent and Trademark Office*